US012221724B2

(12) United States Patent
Fan et al.

(10) Patent No.: US 12,221,724 B2
(45) Date of Patent: Feb. 11, 2025

(54) RECYCLED POLYESTER FILAMENT AND PREPARATION METHOD THEREFOR

(71) Applicant: JIANGSU HENGLI CHEMICAL FIBRE CO., LTD., Wujiang (CN)

(72) Inventors: Hongwei Fan, Wujiang (CN); Shanshui Wang, Wujiang (CN); Lili Wang, Wujiang (CN); Fangming Tang, Wujiang (CN)

(73) Assignee: JIANGSU HENGLI CHEMICAL FIBRE CO., LTD., Wujiang (CN)

( * ) Notice: Subject to any disclaimer, the term of this patent is extended or adjusted under 35 U.S.C. 154(b) by 301 days.

(21) Appl. No.: 17/789,792

(22) PCT Filed: Jun. 12, 2020

(86) PCT No.: PCT/CN2020/095729

§ 371 (c)(1),
(2) Date: Jun. 29, 2022

(87) PCT Pub. No.: WO2021/135085

PCT Pub. Date: Jul. 8, 2021

(65) Prior Publication Data

US 2023/0040916 A1 Feb. 9, 2023

(30) Foreign Application Priority Data

Dec. 31, 2019 (CN) ..... 201911410774.0

(51) Int. Cl.

| | |
|---|---|
| ***D01F 6/62*** | (2006.01) |
| ***D01D 4/02*** | (2006.01) |
| ***D01D 5/08*** | (2006.01) |
| ***D01D 5/088*** | (2006.01) |
| ***D01D 5/22*** | (2006.01) |
| ***D01D 5/253*** | (2006.01) |
| ***D02J 13/00*** | (2006.01) |

(52) U.S. Cl.

CPC ..... *D01F 6/62* (2013.01); *D01D 4/025* (2013.01); *D01D 5/08* (2013.01); *D01D 5/088* (2013.01); *D01D 5/22* (2013.01); *D01D 5/253* (2013.01); *D02J 13/00* (2013.01); *D10B 2331/04* (2013.01)

(58) Field of Classification Search

CPC ..... D01D 4/025; D01D 5/08; D01D 5/088; D01D 5/22; D01D 5/253; B29C 57/005

See application file for complete search history.

(56) References Cited

U.S. PATENT DOCUMENTS 3,061,874 A * 11/1962 Lees ..... D01D 5/088 264/168
3,405,424 A * 10/1968 Imobersteg ..... D01D 5/24 425/464
3,929,542 A * 12/1975 Gehrig ..... D04H 3/105 156/181
4,755,336 A * 7/1988 Deeg ..... C08L 67/02 264/210.4
5,531,951 A * 7/1996 Travelute ..... D01D 5/23 264/209.3
5,730,821 A * 3/1998 Joest ..... D04H 3/007 156/181
2002/0173209 A1* 11/2002 Travelute ..... D01F 6/62 428/397
2003/0144459 A1* 7/2003 Fujimori ..... D01F 6/62 528/277
2016/0102244 A1* 4/2016 Takahashi ..... D01F 8/14 428/401

FOREIGN PATENT DOCUMENTS

| | | | |
|---|---|---|---|
| CN | 102277635 | A | 12/2011 |
| CN | 102864516 | A | 1/2013 |
| CN | 103409832 | A | 11/2013 |
| CN | 203890514 | U | 10/2014 |
| CN | 104357938 | A | 2/2015 |
| CN | 105256398 | A | 1/2016 |
| CN | 107130309 | A | 9/2017 |
| CN | 108035010 | A | 5/2018 |
| CN | 207435595 | U | 6/2018 |
| CN | 111041571 | A | 4/2020 |
| JP | H08232137 | A | 9/1996 |

OTHER PUBLICATIONS

Machine Translation of CN103409832A, Google Patents, 6 pages. (Year: 2024).*
Machine translation of CN108035010A, Google Patents, 13 pages. (Year: 2024).*
Machine translation of CN207435595U, Google Patents, 4 pages. (Year: 2024).*

(Continued)

*Primary Examiner* — Emmanuel S Luk

(74) *Attorney, Agent, or Firm* — Bayramoglu Law Offices LLC

(57) ABSTRACT

A recycled polyester filament and preparation method therefor are disclosed. In the process of preparing a fiber from a recycled polyester according to the FDY process, the ring-blowing is used for cooling, and the distribution of spinneret holes on the spinneret is controlled to meet certain conditions, then the recycled polyester filament is obtained by relaxation heat treatment after a fully drawn yarn is produced. The spinneret holes are C-shaped spinneret holes and circular spinneret holes, the cross-section of the C-shaped spinneret hole is composed of an outer arc, an inner arc, and two line segments, and two endpoints of the outer arc are A and B respectively; wherein the certain conditions include: all the spinneret holes are distributed in concentric circles, and the C-shaped spinneret holes are located on the outermost circle, rotating at different angles and randomly distributed.

12 Claims, No Drawings

(56) References Cited

OTHER PUBLICATIONS

GB/T 6506-2001, Test method for crimp contraction properties of textured filament yarns, Textile Institute of Industrial Standardization, 2001, pp. 1-5.

* cited by examiner

RECYCLED POLYESTER FILAMENT AND PREPARATION METHOD THEREFOR

CROSS REFERENCE TO THE RELATED APPLICATIONS

This application is the national phase entry of International Application No. PCT/CN2020/095729, filed on Jun. 12, 2020, which is based upon and claims priority to Chinese Patent Application No. 201911410774.0, filed on Dec. 31, 2019, the entire contents of which are incorporated herein by reference.

TECHNICAL FIELD

The present invention belongs to the field of fiber, and more particularly, relates to one type of recycled polyester filament and preparation method therefor.

BACKGROUND

Polyethylene Terephthalate (PET) is a widely used synthetic polymer material, which is the dominant material used in the fields of synthetic fibers and food packaging (accounting for more than 80% of the total), and in 2015, the global output of PET exceeded 40 million tons, second only to polyolefins. However, as a non-degradable petroleum-based synthetic polymer material, the social reserves of polyester waste products are also very huge, especially the waste polyester textiles with complex types and high content of impurities are growing at a rate of millions of tons every year, but the current recovery rate is less than 3%, resulting in increasingly serious problems in the waste of petrochemical resources and solid waste pollution. Therefore, the efficient and high-quality recycling technology of waste polyester (especially low-quality waste such as waste polyester textiles) is of great significance to the sustainable development of the industry. The recycling technology of polyester is improving gradually, and the proportion of recycled polyester fibers in the products of recycled polyester is relatively large.

However, the current recycled polyester fiber does not have a three-dimensional crimp shape, therefore does not have some special properties, such as thermal insulation properties, etc., and cannot be used to prepare a variety of filling materials, quilts and other cold-proof supplies, etc., which to a certain extent limits the development of recycled polyester fiber.

SUMMARY

The primary object of the present invention is to provide one type of recycled polyester filament and preparation method therefor, so as to overcome the inadequacies that the recycled polyester fiber in the prior art does not have a three-dimensional crimp shape.

To this end, the technical schemes of the invention are as follows:

The method for preparing a recycled polyester filament, comprising that in the process of preparing a fiber from a recycled polyester (i.e. recycled PET) according to an FDY process, the ring-blowing is used for cooling, and the distribution of spinneret holes on a spinneret is controlled to meet certain conditions, then a recycled polyester filament is obtained by relaxation heat treatment after a fully drawn yarn is produced;

wherein the spinneret holes are C-shaped spinneret holes and circular spinneret holes, the cross-section of the C-shaped spinneret hole is composed of an outer arc M, an inner arc N and two line segments, two endpoints of the outer arc M are A and B respectively, and the length of the line segment AB is greater than 0.1 mm;

wherein the certain conditions comprise: all the spinneret holes are distributed in concentric circles, and the C-shaped spinneret holes are located on the outermost circle, while taking a straight line where two points A and B lie on the cross-section of any one C-shaped spinneret hole as a reference line, the straight lines where two points A and B lie on the cross-section of all other C-shaped spinneret holes have certain angles with the reference line, and the angles are randomly distributed in the range of 0-360°.

After the melt is extruded from the C-shaped spinneret hole, the cooling rate of different positions is inconsistent, in the subsequent process, the part that cools faster is not easy to be drawn and thinned, and its stress is not concentrated, while the part that cools slower is easy to be drawn and thinned, and its stress is concentrated, therefore the stress and thickness on the cross-section of the fiber are asymmetrical. This kind of fiber with stress and thickness asymmetry on the cross-section will have three-dimensional crimp properties during heat treatment or stretching, with good crimps and large elastic recovery rate of the fiber. The invention utilizes the C-shaped spinneret hole to prepare the regenerated polyester filament, so that the three-dimensional crimp shape is produced. The present invention using C-shaped spinneret holes to prepare the recycled polyester filament, making it has three-dimensional crimp shapes.

In addition, generally the monofilament crimping directions of the three-dimensional crimp fiber are the same, which will cause "strip unevenness" when applied to knitted fabrics. Since the stress and thickness asymmetry on the cross-section of the C-shaped fiber will have a greater impact on the three-dimensional crimp shape of the fiber, the present invention controls the distribution of the C-shaped spinneret holes to meet certain conditions, so that the stress and thickness asymmetry on the cross-section of the fibers extruded from different C-shaped spinneret holes have are not exactly the same, which makes crimping of the fibers extruded from different C-shaped spinneret holes are not exactly the same, and the monofilament crimping directions are not exactly the same, breaking the neat left and right spiral shapes of a bundle of fibers, and thus solves the problem of "strip unevenness" in knitted fabrics made from C-shaped recycled polyester fiber.

The following preferred technology program is presented to give a detailed description for this invention:

In the method for preparing a recycled polyester filament, wherein the central angle of M is 180-330°.

wherein the ratio of the number of C-shaped spinneret holes to the number of circular spinneret holes is 70:30 to 80:20.

wherein the recycled polyester melt has an intrinsic viscosity of 0.60-0.70 dL/g.

wherein the FDY process involves technological parameters: a spinning temperature of 270-275° C., a cooling temperature of 20-25° C., a cooling wind speed of 1.80-2.30 m/s, a godet roller 1 speed of 1800-2000 m/min, a godet roller 1 temperature of 85-95° C., a godet roller 2 speed of 3100-3300 m/min, a godet roller 2 temperature of 150-160° C., and a winding speed of 3030-3210 m/min.

wherein the relaxation heat treatment has a temperature of 90-120° C., and a time of 20-30 mm.

The recycled polyester filament prepared by any one of the above preparation methods, is composed of multiple recycled polyester monofilaments with C-shaped cross-section and multiple recycled polyester monofilaments with circular cross-section, the stresses on the cross-section of the same recycled polyester monofilament with C-shaped cross-section are asymmetrical, and the positions of the stress asymmetry on the cross-section of all the recycled polyester monofilaments with C-shaped cross-section are not exactly the same; wherein the recycled polyester filament has a three-dimensional crimp shape and the monofilament crimping directions are randomly distributed.

Prepared through the preferred technology program mentioned above, wherein the recycled polyester filament comprises mechanical performance indices as a crimp shrinkage of 28-33%, a crimp stability of 78-82%, a shrinkage elongation of 65-72%, and a crimp elastic recovery rate of 75-80%.

wherein the recycled polyester filament comprises mechanical performance indices as a breaking strength of ≥2.6 cN/dtex, an elongation at break of 55.0±5.0%, and a total fineness of 100-150 dtex.

Benefits:

(1) The method for preparing a recycled polyester filament in the present invention, wherein the recycled polyester filaments with three-dimensional crimp shapes is prepared by using C-shaped spinneret holes;

(2) The method for preparing a recycled polyester filament in the present invention, solves the problem of "strip unevenness" in knitted fabrics made from three-dimensional crimp fibers by controlling the distribution of spinneret holes on the spinneret to meet certain conditions;

(3) The method for preparing a recycled polyester filament in the present invention, has excellent comprehensive properties.

DETAILED DESCRIPTION OF THE EMBODIMENTS

Based on above mentioned method, the following embodiments are carried out for further demonstration in the present invention. It is to be understood that these embodiments are only intended to illustrate the invention and are not intended to limit the scope of the invention. In addition, it should be understood that after reading the contents described in the present invention, those technical personnel in this field can make various changes or modifications to the invention, and these equivalent forms also fall within the scope of the claims attached to the application.

The crimp shrinkage and crimp stability in the present invention are obtained by testing the tow by using GB6506-2001 "Synthetic fiber-Test method for crimp contraction properties of textured filament yarns";

The text methods of the shrinkage elongation (reflecting the degree of elasticity and crimp of textured filament yarns, wherein the fibers are subjected to a light load and then to a heavy load, and the ratio of the difference in length to the curl length is calculated for both loads) and the crimp elastic recovery rate are as follows:

Firstly, cut two fiber samples of about 50 cm in length, put them into 100° C. hot water for 30 minutes, take them out and dry them naturally, next intercept a sample of about 30 cm in length, wherein fix one end and load another end with a load of 0.0018 cN/dtex for 30 seconds, and mark it at 20 cm, that is, the initial length $l_1$ of the sample; then load another end with a load of 0.09 cN/dtex for 30 seconds, and measure the position of the marked point, which is the length $l_2$ of the sample under heavier load; finally remove the load and let the sample retract for 2 minutes, next add a load of 0.0018 cN/dtex for 30 seconds and measure the position of the marked point, which is the recovery length $l_3$; the shrinkage elongation (CE) and the crimp elastic recovery rate (SR) are calculated as follows:

$$CE=(l_2-l_1)/l_1;$$

$$SR=(l_2-l_3)/(l_2-l_1).$$

Example 1

A method for preparing a recycled polyester filament, comprising that in the process of preparing a fiber from a recycled polyester with an intrinsic viscosity of 0.6 dL/g according to an FDY process, the ring-blowing is used for cooling, and the distribution of spinneret holes on a spinneret is controlled to meet certain conditions, then a recycled polyester filament is obtained by relaxation heat treatment after a fully drawn yarn is produced;

wherein the spinneret holes are C-shaped spinneret holes and circular spinneret holes, the cross-section of the C-shaped spinneret hole is composed of an outer arc M, an inner arc N and two line segments, two endpoints of the outer arc M are A and B respectively, and the length of the line segment AB is 0.11 mm;

wherein the certain conditions comprise: all the spinneret holes are distributed in concentric circles, the ratio of the number of C-shaped spinneret holes to the number of circular spinneret holes is 70:30, and the C-shaped spinneret holes are located on the outermost circle with equidistant distribution, the number of which is 24, while taking a straight line where two points A and B lie on the cross-section of any one C-shaped spinneret hole as a reference line, the straight lines where two points A and B lie on the cross-section of all other C-shaped spinneret holes have certain angles with the reference line, along the clockwise direction, the included angles of the inferior angles are 20°, 75°, 15°, 22°, 3°, 170°, 40°, 90°, 1°, 45°, 30°, 10°, 10°, 60°, 2°, 100°, 106°, 100°, 41°, 80°, 65°, 2°, 50°;

wherein the FDY process involves technological parameters: a spinning temperature of 270° C., a cooling temperature of 20° C., a cooling wind speed of 1.80 m/s, a godet roller 1 speed of 1800 m/min, a godet roller 1 temperature of 85° C., a godet roller 2 speed of 3100 m/min, a godet roller 2 temperature of 150° C., and a winding speed of 3030 m/min;

wherein the relaxation heat treatment has a temperature of 90° C., and a time of 30 min;

wherein the prepared recycled polyester filament comprises multiple recycled polyester monofilaments with C-shaped cross-section and multiple recycled polyester monofilaments with circular cross-section, the stresses on the cross-section of the same recycled polyester monofilament with C-shaped cross-section are asymmetrical, and the positions of the stress asymmetry on the cross-section of all the recycled polyester monofilaments with C-shaped cross-section are not exactly the same; wherein the recycled polyester filament has a three-dimensional crimp shape and the monofilament crimping directions are randomly distributed; wherein the recycled polyester filament comprises mechanical performance indices as a crimp shrinkage of 28%, a crimp stability of 78%, a shrinkage elongation of 65%, a crimp elastic recovery rate of 75%, a breaking strength of 2.6 cN/dtex, an elongation at break of 60%, and a total fineness of 100 dtex.

Example 2

A method for preparing a recycled polyester filament, comprising that in the process of preparing a fiber from a recycled polyester with an intrinsic viscosity of 0.6 dL/g according to an FDY process, the ring-blowing is used for cooling, and the distribution of spinneret holes on a spinneret is controlled to meet certain conditions, then a recycled polyester filament is obtained by relaxation heat treatment after a fully drawn yarn is produced;

wherein the spinneret holes are C-shaped spinneret holes and circular spinneret holes, the cross-section of the C-shaped spinneret hole is composed of an outer arc M, an inner arc N and two line segments, two endpoints of the outer arc M are A and B respectively, and the length of the line segment AB is 0.11 mm;

wherein the certain conditions comprise: all the spinneret holes are distributed in concentric circles, the ratio of the number of C-shaped spinneret holes to the number of circular spinneret holes is 80:20, and the C-shaped spinneret holes are located on the outermost circle with equidistant distribution, the number of which is 24, while taking a straight line where two points A and B lie on the cross-section of any one C-shaped spinneret hole as a reference line, the straight lines where two points A and B lie on the cross-section of all other C-shaped spinneret holes have certain angles with the reference line, along the clockwise direction, the included angles of the inferior angles are 30°, 75°, 65°, 20°, 3°, 170°, 40°, 90°, 1°, 45°, 30°, 10°, 10°, 60°, 2°, 100°, 106°, 100°, 41°, 80°, 65°, 2°, 50°;

wherein the FDY process involves technological parameters: a spinning temperature of 270° C., a cooling temperature of 20° C., a cooling wind speed of 2.2 m/s, a godet roller 1 speed of 1807 m/min, a godet roller 1 temperature of 85° C., a godet roller 2 speed of 3168 m/min, a godet roller 2 temperature of 150° C., and a winding speed of 3086 m/min;

wherein the relaxation heat treatment has a temperature of 90° C., and a time of 30 min;

wherein the prepared recycled polyester filament comprises multiple recycled polyester monofilaments with C-shaped cross-section and multiple recycled polyester monofilaments with circular cross-section, the stresses on the cross-section of the same recycled polyester monofilament with C-shaped cross-section are asymmetrical, and the positions of the stress asymmetry on the cross-section of all the recycled polyester monofilaments with C-shaped cross-section are not exactly the same; wherein the recycled polyester filament has a three-dimensional crimp shape and the monofilament crimping directions are randomly distributed; wherein the recycled polyester filament comprises mechanical performance indices as a crimp shrinkage of 28%, a crimp stability of 78%, a shrinkage elongation of 66%, a crimp elastic recovery rate of 75%, a breaking strength of 2.6 cN/dtex, an elongation at break of 59.1%, and a total fineness of 104 dtex.

Example 3

A method for preparing a recycled polyester filament, comprising that in the process of preparing a fiber from a recycled polyester with an intrinsic viscosity of 0.69 dL/g according to an FDY process, the ring-blowing is used for cooling, and the distribution of spinneret holes on a spinneret is controlled to meet certain conditions, then a recycled polyester filament is obtained by relaxation heat treatment after a fully drawn yarn is produced;

wherein the spinneret holes are C-shaped spinneret holes and circular spinneret holes, the cross-section of the C-shaped spinneret hole is composed of an outer arc M, an inner arc N and two line segments, two endpoints of the outer arc M are A and B respectively, and the length of the line segment AB is 0.11 mm;

wherein the certain conditions comprise: all the spinneret holes are distributed in concentric circles, the ratio of the number of C-shaped spinneret holes to the number of circular spinneret holes is 80:20, and the C-shaped spinneret holes are located on the outermost circle with equidistant distribution, the number of which is 24, while taking a straight line where two points A and B lie on the cross-section of any one C-shaped spinneret hole as a reference line, the straight lines where two points A and B lie on the cross-section of all other C-shaped spinneret holes have certain angles with the reference line, along the clockwise direction, the included angles of the inferior angles are 30°, 75°, 18°, 22°, 13°, 170°, 56°, 90°, 1°, 45°, 30°, 10°, 10°, 60°, 2°, 100°, 106°, 100°, 41°, 80°, 65°, 2°, 50°;

wherein the FDY process involves technological parameters: a spinning temperature of 272° C., a cooling temperature of 24° C., a cooling wind speed of 2 m/s, a godet roller 1 speed of 1814 m/min, a godet roller 1 temperature of 89° C., a godet roller 2 speed of 3178 m/min, a godet roller 2 temperature of 153° C., and a winding speed of 3139 m/min;

wherein the relaxation heat treatment has a temperature of 93° C., and a time of 30 min;

wherein the prepared recycled polyester filament comprises multiple recycled polyester monofilaments with C-shaped cross-section and multiple recycled polyester monofilaments with circular cross-section, the stresses on the cross-section of the same recycled polyester monofilament with C-shaped cross-section are asymmetrical, and the positions of the stress asymmetry on the cross-section of all the recycled polyester monofilaments with C-shaped cross-section are not exactly the same; wherein the recycled polyester filament has a three-dimensional crimp shape and the monofilament crimping directions are randomly distributed; wherein the recycled polyester filament comprises mechanical performance indices as a crimp shrinkage of 29%, a crimp stability of 79%, a shrinkage elongation of 67%, a crimp elastic recovery rate of 75%, a breaking strength of 2.6 cN/dtex, an elongation at break of 59%, and a total fineness of 117 dtex.

Example 4

A method for preparing a recycled polyester filament, comprising that in the process of preparing a fiber from a recycled polyester with an intrinsic viscosity of 0.6 dL/g according to an FDY process, the ring-blowing is used for cooling, and the distribution of spinneret holes on a spinneret is controlled to meet certain conditions, then a recycled polyester filament is obtained by relaxation heat treatment after a fully drawn yarn is produced;

wherein the spinneret holes are C-shaped spinneret holes and circular spinneret holes, the cross-section of the C-shaped spinneret hole is composed of an outer arc M, an inner arc N and two line segments, two endpoints of the outer arc M are A and B respectively, and the length of the line segment AB is 0.13 mm;

wherein the certain conditions comprise: all the spinneret holes are distributed in concentric circles, the ratio of the number of C-shaped spinneret holes to the number of circular spinneret holes is 80:20, and the C-shaped spinneret holes are located on the outermost circle with equidistant distribution, the number of which is 24, while taking a straight line where two points A and B lie on the cross-section of any one C-shaped spinneret hole as a reference line, the straight lines where two points A and B lie on the cross-section of all other C-shaped spinneret holes have certain angles with the reference line, along the clockwise direction, the included angles of the inferior angles are 30°, 75°, 15°, 22°, 3°, 170°, 12°, 90°, 1°, 45°, 30°, 10°, 10°, 60°, 2°, 100°, 80°, wherein the FDY process involves technological parameters: a spinning temperature of 273° C., a cooling temperature of 22° C., a cooling wind speed of 1.8 m/s, a godet roller 1 speed of 1822 m/min, a godet roller 1 temperature of 90° C., a godet roller 2 speed of 3203 m/min, a godet roller 2 temperature of 154° C., and a winding speed of 3163 m/min;

wherein the relaxation heat treatment has a temperature of 106° C., and a time of 29 min;

wherein the prepared recycled polyester filament comprises multiple recycled polyester monofilaments with C-shaped cross-section and multiple recycled polyester monofilaments with circular cross-section, the stresses on the cross-section of the same recycled polyester monofilament with C-shaped cross-section are asymmetrical, and the positions of the stress asymmetry on the cross-section of all the recycled polyester monofilaments with C-shaped cross-section are not exactly the same; wherein the recycled polyester filament has a three-dimensional crimp shape and the monofilament crimping directions are randomly distributed; wherein the recycled polyester filament comprises mechanical performance indices as a crimp shrinkage of 29%, a crimp stability of 79%, a shrinkage elongation of 68%, a crimp elastic recovery rate of 76%, a breaking strength of 2.6 cN/dtex, an elongation at break of 58.5%, and a total fineness of 120 dtex.

Example 5

A method for preparing a recycled polyester filament, comprising that in the process of preparing a fiber from a recycled polyester with an intrinsic viscosity of 0.7 dL/g according to an FDY process, the ring-blowing is used for cooling, and the distribution of spinneret holes on a spinneret is controlled to meet certain conditions, then a recycled polyester filament is obtained by relaxation heat treatment after a fully drawn yarn is produced;

wherein the spinneret holes are C-shaped spinneret holes and circular spinneret holes, the cross-section of the C-shaped spinneret hole is composed of an outer arc M, an inner arc N and two line segments, two endpoints of the outer arc M are A and B respectively, and the length of the line segment AB is 0.12 mm;

wherein the certain conditions comprise: all the spinneret holes are distributed in concentric circles, the ratio of the number of C-shaped spinneret holes to the number of circular spinneret holes is 80:20, and the C-shaped spinneret holes are located on the outermost circle with equidistant distribution, the number of which is 24, while taking a straight line where two points A and B lie on the cross-section of any one C-shaped spinneret hole as a reference line, the straight lines where two points A and B lie on the cross-section of all other C-shaped spinneret holes have certain angles with the reference line, along the clockwise direction, the included angles of the inferior angles are 30°, 75°, 15°, 20°, 3°, 170°, 40°, 90°, 1°, 45°, 30°, 10°, 10°, 60°, 2°, 100°, 106°, 100°, 41°, 80°, 65°, 2°, 50°;

wherein the FDY process involves technological parameters: a spinning temperature of 274° C., a cooling temperature of 21° C., a cooling wind speed of 2.2 m/s, a godet roller 1 speed of 1852 m/min, a godet roller 1 temperature of 90° C., a godet roller 2 speed of 3227 m/min, a godet roller 2 temperature of 154° C., and a winding speed of 3180 m/min;

wherein the relaxation heat treatment has a temperature of 114° C., and a time of 28 min;

wherein the prepared recycled polyester filament comprises multiple recycled polyester monofilaments with C-shaped cross-section and multiple recycled polyester monofilaments with circular cross-section, the stresses on the cross-section of the same recycled polyester monofilament with C-shaped cross-section are asymmetrical, and the positions of the stress asymmetry on the cross-section of all the recycled polyester monofilaments with C-shaped cross-section are not exactly the same; wherein the recycled polyester filament has a three-dimensional crimp shape and the monofilament crimping directions are randomly distributed; wherein the recycled polyester filament comprises mechanical performance indices as a crimp shrinkage of 31%, a crimp stability of 79%, a shrinkage elongation of 71%, a crimp elastic recovery rate of 76%, a breaking strength of 2.8 cN/dtex, an elongation at break of 57.8%, and a total fineness of 135 dtex.

Example 6

A method for preparing a recycled polyester filament, comprising that in the process of preparing a fiber from a recycled polyester with an intrinsic viscosity of 0.6 dL/g according to an FDY process, the ring-blowing is used for cooling, and the distribution of spinneret holes on a spinneret is controlled to meet certain conditions, then a recycled polyester filament is obtained by relaxation heat treatment after a fully drawn yarn is produced;

wherein the spinneret holes are C-shaped spinneret holes and circular spinneret holes, the cross-section of the C-shaped spinneret hole is composed of an outer arc M, an inner arc N and two line segments, two endpoints of the outer arc M are A and B respectively, and the length of the line segment AB is 0.11 mm;

wherein the certain conditions comprise: all the spinneret holes are distributed in concentric circles, the ratio of the number of C-shaped spinneret holes to the number of circular spinneret holes is 70:30, and the C-shaped spinneret holes are located on the outermost circle with equidistant distribution, the number of which is 24, while taking a straight line where two points A and B lie on the cross-section of any one C-shaped spinneret hole as a reference line, the straight lines where two points A and B lie on the cross-section of all other C-shaped spinneret holes have certain angles with the reference line, along the clockwise direction, the included angles of the inferior angles are 30°, 75°, 15°, 22°, 3°, 170°, 31°, 90°, 1°, 45°, 30°, 10°, 10°, 60°, 2°, 100°, 106°, 100°, 41°, 80°, 65°, 2°, 50°;

wherein the FDY process involves technological parameters: a spinning temperature of 275° C., a cooling temperature of 22° C., a cooling wind speed of 1.9 m/s, a godet roller 1 speed of 1911 m/min, a godet roller 1 temperature of 92° C., a godet roller 2 speed of 3265 m/min, a godet roller 2 temperature of 158° C., and a winding speed of 3185 m/min;

wherein the relaxation heat treatment has a temperature of 115° C., and a time of 25 min;

wherein the prepared recycled polyester filament comprises multiple recycled polyester monofilaments with C-shaped cross-section and multiple recycled polyester monofilaments with circular cross-section, the stresses on the cross-section of the same recycled polyester monofilament with C-shaped cross-section are asymmetrical, and the positions of the stress asymmetry on the cross-section of all the recycled polyester monofilaments with C-shaped cross-section are not exactly the same; wherein the recycled polyester filament has a three-dimensional crimp shape and the monofilament crimping directions are randomly distributed; wherein the recycled polyester filament comprises mechanical performance indices as a crimp shrinkage of 32%, a crimp stability of 82%, a shrinkage elongation of 71%, a crimp elastic recovery rate of 76%, a breaking strength of 2.8 cN/dtex, an elongation at break of 57.6%, and a total fineness of 132 dtex.

Example 7

A method for preparing a recycled polyester filament, comprising that in the process of preparing a fiber from a recycled polyester with an intrinsic viscosity of 0.63 dL/g according to an FDY process, the ring-blowing is used for cooling, and the distribution of spinneret holes on a spinneret is controlled to meet certain conditions, then a recycled polyester filament is obtained by relaxation heat treatment after a fully drawn yarn is produced;

wherein the spinneret holes are C-shaped spinneret holes and circular spinneret holes, the cross-section of the C-shaped spinneret hole is composed of an outer arc M, an inner arc N and two line segments, two endpoints of the outer arc M are A and B respectively, and the length of the line segment AB is 0.11 mm;

wherein the certain conditions comprise: all the spinneret holes are distributed in concentric circles, the ratio of the number of C-shaped spinneret holes to the number of circular spinneret holes is 70:30, and the C-shaped spinneret holes are located on the outermost circle with equidistant distribution, the number of which is 12, while taking a straight line where two points A and B lie on the cross-section of any one C-shaped spinneret hole as a reference line, the straight lines where two points A and B lie on the cross-section of all other C-shaped spinneret holes have certain angles with the reference line, along the clockwise direction, the included angles of the inferior angles are 3°, 170°, 40°, 90°, 1°, 45°, 30°, 10°, 10°, 60°, 2°;

wherein the FDY process involves technological parameters: a spinning temperature of 275° C., a cooling temperature of 24° C., a cooling wind speed of 2.3 m/s, a godet roller 1 speed of 1981 m/min, a godet roller 1 temperature of 93° C., a godet roller 2 speed of 3284 m/min, a godet roller 2 temperature of 159° C., and a winding speed of 3202 m/min;

wherein the relaxation heat treatment has a temperature of 116° C., and a time of 22 min;

wherein the prepared recycled polyester filament comprises multiple recycled polyester monofilaments with C-shaped cross-section and multiple recycled polyester monofilaments with circular cross-section, the stresses on the cross-section of the same recycled polyester monofilament with C-shaped cross-section are asymmetrical, and the positions of the stress asymmetry on the cross-section of all the recycled polyester monofilaments with C-shaped cross-section are not exactly the same; wherein the recycled polyester filament has a three-dimensional crimp shape and the monofilament crimping directions are randomly distributed; wherein the recycled polyester filament comprises mechanical performance indices as a crimp shrinkage of 33%, a crimp stability of 82%, a shrinkage elongation of 71%, a crimp elastic recovery rate of 80%, a breaking strength of 2.9 cN/dtex, an elongation at break of 56.9%, and a total fineness of 146 dtex.

Example 8

A method for preparing a recycled polyester filament, comprising that in the process of preparing a fiber from a recycled polyester with an intrinsic viscosity of 0.7 dL/g according to an FDY process, the ring-blowing is used for cooling, and the distribution of spinneret holes on a spinneret is controlled to meet certain conditions, then a recycled polyester filament is obtained by relaxation heat treatment after a fully drawn yarn is produced;

wherein the spinneret holes are C-shaped spinneret holes and circular spinneret holes, the cross-section of the C-shaped spinneret hole is composed of an outer arc M, an inner arc N and two line segments, two endpoints of the outer arc M are A and B respectively, and the length of the line segment AB is 0.14 mm;

wherein the certain conditions comprise: all the spinneret holes are distributed in concentric circles, the ratio of the number of C-shaped spinneret holes to the number of circular spinneret holes is 70:30, and the C-shaped spinneret holes are located on the outermost circle with equidistant distribution, the number of which is 12, while taking a straight line where two points A and B lie on the cross-section of any one C-shaped spinneret hole as a reference line, the straight lines where two points A and B lie on the cross-section of all other C-shaped spinneret holes have certain angles with the reference line, along the clockwise direction, the included angles of the inferior angles are 15°, 22°, 3°, 45°, 30°, 10°, 10°, 60°, 2°, 98°, 106°;

wherein the FDY process involves technological parameters: a spinning temperature of 275° C., a cooling temperature of 25° C., a cooling wind speed of 2.3 m/s, a godet roller 1 speed of 2000 m/min, a godet roller 1 temperature of 95° C., a godet roller 2 speed of 3300 m/min, a godet roller 2 temperature of 160° C., and a winding speed of 3210 m/min;

wherein the relaxation heat treatment has a temperature of 120° C., and a time of 20 min;

wherein the prepared recycled polyester filament comprises multiple recycled polyester monofilaments with C-shaped cross-section and multiple recycled polyester monofilaments with circular cross-section, the stresses on the cross-section of the same recycled polyester monofilament with C-shaped cross-section are asymmetrical, and the positions of the stress asymmetry on the cross-section of all the recycled polyester monofilaments with C-shaped cross-section are not exactly the same; wherein the recycled polyester filament has a three-dimensional crimp shape and the monofilament crimping directions are randomly distributed; wherein the recycled polyester filament comprises mechanical performance indices as a crimp shrinkage of 33%, a crimp stability of 82%, a shrinkage elongation of 72%, a crimp elastic recovery rate of 80%, a breaking strength of 2.9 cN/dtex, an elongation at break of 50%, and a total fineness of 150 dtex.

What is claimed is:

1. A method for preparing a recycled polyester filament, comprising:

using a ring-blowing for cooling in a process of preparing a fiber from a recycled polyester according to an FDY process;

controlling a distribution of spinneret holes on a spinneret to meet certain conditions; and obtaining the recycled polyester filament by a relaxation heat treatment after a fully drawn yarn is produced;

wherein the ring-blowing cooling has a cooling temperature of 20-25° C. and a cooling wind speed of 1.80-2.30 m/s;

wherein the spinneret holes are C-shaped spinneret holes and circular spinneret holes, a cross-section of each of the C-shaped spinneret holes is composed of an outer arc, an inner arc, and two line segments, two endpoints of the outer arc are A and B respectively, and a length of the line segment AB is greater than 0.1 mm; and wherein the certain conditions comprise: all of the spinneret holes are distributed in concentric circles, the C-shaped spinneret holes are located on an outermost circle, and a ratio of a number of the C-shaped spinneret holes to a number of the circular spinneret holes is 70:30 to 80:20; and while taking a straight line connecting endpoints A and B of one of the C-shaped spinneret holes as a reference line, straight lines connecting endpoints A and B of all other C-shaped spinneret holes form certain angles with the reference line, and the angles are different and are randomly distributed in a range of 0-360°.

2. The method of claim 1, wherein a central angle of the outer arc is 180-330°.

3. The method of claim 2, wherein a recycled polyester melt has an intrinsic viscosity of 0.60-0.70 dL/g.

4. The method of claim 3, wherein the FDY process involves technological parameters: a spinning temperature of 270-275° C., a first godet roller speed of 1800-2000 m/min, a first godet roller temperature of 85-95° C., a second godet roller speed of 3100-3300 m/min, a second godet roller temperature of 150-160° C., and a winding speed of 3030-3210 m/min.

5. The method of claim 4, wherein the relaxation heat treatment has a temperature of 90-120° C. and a time of 20-30 min.

6. A recycled polyester filament prepared by the method of claim 1, wherein the recycled polyester filament comprises multiple recycled polyester monofilaments with a C-shaped cross-section and multiple recycled polyester monofilaments with a circular cross-section, stresses on the cross-section of a same recycled polyester monofilament with the C-shaped cross-section are asymmetrical, and positions of a tress asymmetry on the cross-section of all the recycled polyester monofilaments with the C-shaped cross-section are not exactly the same; wherein the recycled polyester filament has a three-dimensional crimp shape and monofilament crimping directions are randomly distributed.

7. The recycled polyester filament of claim 6, wherein the recycled polyester filament comprises mechanical performance indices as a crimp shrinkage of 28-33%, a crimp stability of 78-82%, a shrinkage elongation of 65-72%, and a crimp elastic recovery rate of 75-80%.

8. The recycled polyester filament of claim 6, wherein the recycled polyester filament comprises mechanical performance indices as a breaking strength of ≥2.6 cN/dtex, an elongation at break of 55.0±5.0%, and a total fineness of 100-150 dtex.

9. The recycled polyester filament of claim 6, wherein during a preparation of the recycled polyester filament, a central angle of the outer arc is 180-330°.

10. The recycled polyester filament of claim 9, wherein during the preparation of the recycled polyester filament, a recycled polyester melt has an intrinsic viscosity of 0.60-0.70 dL/g.

11. The recycled polyester filament of claim 10, wherein during the preparation of the recycled polyester filament, the FDY process involves technological parameters: a spinning temperature of 270-275° C., a first godet roller speed of 1800-2000 m/min, a first godet roller temperature of 85-95° C., a second godet roller speed of 3100-3300 m/min, a second godet roller temperature of 150-160° C., and a winding speed of 3030-3210 m/min.

12. The recycled polyester filament of claim 11, wherein during the preparation of the recycled polyester filament, the relaxation heat treatment has a temperature of 90-120° C. and a time of 20-30 min.

* * * * *